US010056038B2

(12) United States Patent
Xiang et al.

(10) Patent No.: US 10,056,038 B2
(45) Date of Patent: Aug. 21, 2018

(54) ORGANIC LIGHT EMITTING DISPLAY PANEL, DRIVING METHOD THEREOF AND ORGANIC LIGHT EMITTING DISPLAY APPARATUS

(71) Applicant: SHANGHAI TIANMA AM-OLED CO., LTD., Shanghai (CN)

(72) Inventors: Dongxu Xiang, Shanghai (CN); Yue Li, Shanghai (CN); Tong Wu, Shanghai (CN); Zeyuan Chen, Shanghai (CN); Gang Liu, Shanghai (CN); Dong Qian, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 0 days.

(21) Appl. No.: 15/593,929

(22) Filed: May 12, 2017

(65) Prior Publication Data

US 2017/0249903 A1 Aug. 31, 2017

(30) Foreign Application Priority Data

Jan. 5, 2017 (CN) ..... 2017 1 0007311

(51) Int. Cl.

| | |
|---|---|
| ***G09G 3/36*** | (2006.01) |
| ***G09G 3/3258*** | (2016.01) |
| ***G09G 3/3266*** | (2016.01) |

(52) U.S. Cl.

CPC ..... *G09G 3/3258* (2013.01); *G09G 3/3266* (2013.01); *G09G 2300/0871* (2013.01); *G09G 2310/08* (2013.01); *G09G 2320/0233* (2013.01)

(58) Field of Classification Search

CPC .. G09G 3/30; G09G 3/36; G09G 3/20; G09G 3/22; G09G 5/00; G09G 3/10; G06F 3/038

See application file for complete search history.

(56) References Cited

U.S. PATENT DOCUMENTS

| | | | | |
|---|---|---|---|---|
| 2016/0042694 | A1* | 2/2016 | Lim | G09G 3/3233 345/78 |
| 2016/0125800 | A1* | 5/2016 | Kim | G09G 3/3225 345/212 |
| 2016/0133190 | A1* | 5/2016 | Kim | G09G 3/2011 345/80 |
| 2017/0110056 | A1* | 4/2017 | Hu | G09G 3/3258 |
| 2017/0193919 | A1* | 7/2017 | Hwang | G09G 3/3291 |

* cited by examiner

*Primary Examiner* — Pegeman Karimi
(74) *Attorney, Agent, or Firm* — Alston & Bird LLP

(57) ABSTRACT

The present disclosure discloses an organic light emitting display panel, a driving method thereof, and an organic light emitting display apparatus. The organic light emitting display panel includes a plurality of pixel driving circuits, comprising: a driving module including a driving transistor and a first capacitor; an initialization module for initializing potentials of a gate and a first electrode of the driving transistor at least under the control of a first scanning signal terminal; a data writing module for transmitting a signal of a data signal terminal to a second electrode plate of a first capacitor under the control of the first or a second scanning signal terminal; a light emitting control module for transmitting a potential signal of the first electrode of the driving transistor to the second electrode plate of the first capacitor and driving an organic light emitting diode to emit light.

18 Claims, 9 Drawing Sheets

ORGANIC LIGHT EMITTING DISPLAY PANEL, DRIVING METHOD THEREOF AND ORGANIC LIGHT EMITTING DISPLAY APPARATUS

CROSS REFERENCE TO RELATED DISCLOSURE

This disclosure claims the benefit of Chinese Patent Disclosure No. CN201710007311.4, filed on Jan. 5, 2017, entitled "Organic Light Emitting Display Panel, Driving Method thereof and Organic Light Emitting Display Apparatus," the disclosure of which is incorporated herein in its entirety by reference.

TECHNICAL FIELD

The present disclosure relates to the field of display technology, and specifically relates to an organic light emitting display panel and a driving method thereof, and an organic light emitting display apparatus.

BACKGROUND

Utilizing the self-luminous property of organic semiconductor material for displaying, an organic light emitting display has the advantages of, among others, high contrast and low power consumption. Typically, the display area of the organic light emitting display is provided with a pixel array composed of sub-pixels. Each sub-pixel contains an organic light emitting diode, driven by a pixel driving circuit to emit light.

A conventional pixel driving circuit may include a driving transistor which provides a light emitting current to an organic light emitting device under the control of a light emitting control signal. The light emitting current of the organic light emitting diode is related to a threshold voltage Vth of the driving transistor, but the threshold voltage Vth of the driving transistor will shift (i.e. "threshold shift") due to manufacture, aging after extended use, and other causes, so that the luminance of the organic light emitting device is unstable. In addition, in the conventional pixel driving circuit, the light emitting current of the organic light emitting diode is related to a capacitance value thereof, and the capacitance values of different organic light emitting diodes are not equal. When an identical data signal is provided to different pixel driving circuits, the luminances of the organic light emitting diodes are therefore not equal, thus causing the problem of uneven display.

SUMMARY

The present disclosure provides an organic light emitting display panel and a driving method thereof, and an organic light emitting display apparatus to solve the technical problems mentioned in background section.

In a first aspect, the present disclosure provides an organic light emitting display panel including a plurality of pixel driving circuits arranged in a matrix, the pixel driving circuit including a first scanning signal terminal, a second scanning signal terminal, a first light emitting signal terminal, a second light emitting signal terminal, a data signal terminal, a first initialization signal terminal, a first voltage terminal, a second voltage terminal, a driving module, an initialization module, a data writing module, a light emitting control module and an organic light emitting diode. The driving module includes a driving transistor and a first capacitor, the first capacitor including a first electrode plate and a second electrode plate, a gate of the driving transistor being electrically connected to the first electrode plate of the first capacitor, a first electrode of the driving transistor being electrically connected to an anode of the organic light emitting diode. The initialization module is electrically connected to the first scanning signal terminal and the first initialization signal terminal, for initializing potentials of the gate and the first electrode of the driving transistor at least under the control of the first scanning signal terminal. The data writing module is electrically connected to the first scanning signal terminal or the second scanning signal terminal and the data signal terminal, for transmitting a signal of the data signal terminal to the second electrode plate of the first capacitor under the control of the first scanning signal terminal or the second scanning signal terminal. The light emitting control module is electrically connected to the first light emitting signal terminal, the second light emitting signal terminal, the first voltage terminal and the first electrode and a second electrode of the driving transistor, for transmitting the potential signal of the first electrode of the driving transistor to the second electrode plate of the first capacitor under the control of the first light emitting signal terminal, and driving the organic light emitting diode to emit light based on a signal of the first voltage terminal under the control of the second light emitting signal terminal. A cathode of the organic light emitting diode is electrically connected to the second voltage terminal.

In a second aspect, the present disclosure provides a driving method applied to the organic light emitting display panel, comprising: in a first phase, providing a first level signal to the first scanning signal terminal and the second light emitting signal terminal, providing a second level signal to the first light emitting signal terminal, providing a first data signal to the data signal terminal, the initialization module initializing the potentials of the gate of the driving transistor and the second electrode of the driving transistor; in a second phase, providing the second level signal to the first light emitting signal terminal and the second light emitting signal terminal, providing the first level signal to the second scanning signal terminal, providing a first initialization signal to the first initialization signal terminal, the initialization module transmitting the first initialization signal to the first electrode of the driving transistor; in a third phase, providing the first level signal to the first light emitting signal terminal, the potential at the gate of the driving transistor changing under the coupling of the first capacitor; in a fourth phase, providing the first level signal to the first light emitting signal terminal and the second light emitting signal terminal, providing the second level signal to the first scanning signal terminal and the second scanning signal terminal, the organic light emitting diode emitting light based on a potential difference between the gate and the first electrode of the driving transistor In a third aspect, the present disclosure provides an organic light emitting display apparatus, including the organic light emitting display panel.

The organic light emitting display panel and the driving method thereof, and the organic light emitting display apparatus provided by the present disclosure may compensate a threshold voltage of the driving transistor while the light emitting control module may control the first capacitor to be disconnected from the organic light emitting diode. Thus, the electric charge generated by the coupling in the second electrode plate of the first capacitor is not transmitted to the organic light emitting diode, so that the light emitting current of the organic light emitting diode is independent of its capacitance value, thereby improving the uniformity of the display luminance of the display panel.

BRIEF DESCRIPTION OF THE DRAWINGS

Other features, objectives and advantages of the present disclosure will become more apparent upon reading the detailed description to non-limiting embodiments with reference to the accompanying drawings, wherein.

DETAILED DESCRIPTION OF EMBODIMENTS

The present disclosure will be further described below in detail in combination with the accompanying drawings and the embodiments. It should be appreciated that the specific embodiments described herein are merely used for explaining the relevant invention, rather than limiting the invention. In addition, it should be noted that, for the ease of description, only the parts related to the relevant invention are shown in the accompanying drawings.

It should also be noted that the embodiments in the present disclosure and the features in the embodiments may be combined with each other on a non-conflict basis. The present disclosure will be described below in detail with reference to the accompanying drawings and in combination with the embodiments.

Figure 1:
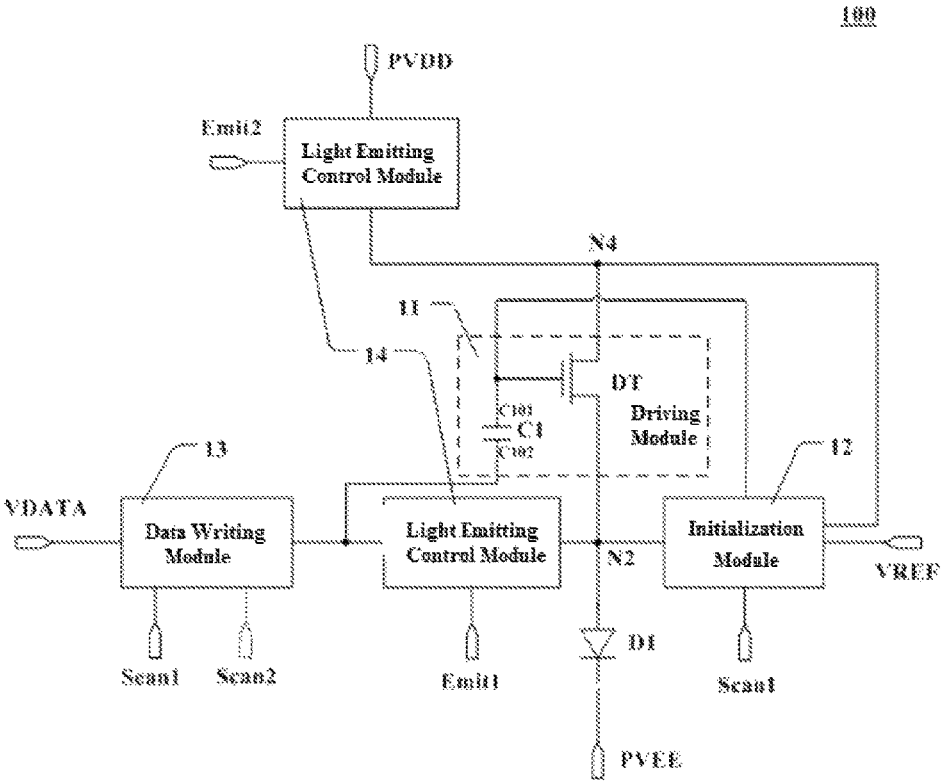
FIG. 1 is a schematic structural diagram of an embodiment of a pixel driving circuit in an organic light emitting display panel according to the present disclosure.

Referring to FIG. 1, a schematic structural diagram of an embodiment of a pixel driving circuit in an organic light emitting display panel according to the present disclosure is illustrated. In the present embodiment, the organic light emitting display panel includes a plurality of pixel driving circuits 100 arranged in an array.

As shown in FIG. 1, each pixel driving circuit 100 includes a first scanning signal terminal Scan1, a second scanning signal terminal Scan2, a first light emitting signal terminal Emit1, a second light emitting signal terminal Emit2, a data signal terminal VDATA, a first initialization signal terminal VREF, a first voltage terminal PVDD, a second voltage terminal PVEE, a driving module 11, an initialization module 12, a data writing module 13, a light emitting control module 14 and an organic light emitting diode D1.

The driving module 11 includes a driving transistor DT and a first capacitor C1. The first capacitor C1 includes a first electrode plate C101 and a second electrode plate C102, a gate (N1 node) of the driving transistor DT is electrically connected to the first electrode plate C101 of the first capacitor C1, a first electrode (N2 node) of the driving transistor DT is electrically connected to an anode of the organic light emitting diode D1. The second electrode plate C102 of the first capacitor C1 may be electrically connected to the light emitting control module 14. A second electrode (N4 node) of the driving transistor DT may also be electrically connected to the light emitting control module 14.

The initialization module 12 is electrically connected to the first scanning signal terminal Scan1 and the first initialization signal terminal VREF, for initializing potentials of the gate and the first electrode of the driving transistor DT at least under the control of the first scanning signal terminal Scan1. Alternatively, in some embodiments, the initialization module 12 may also be electrically connected to the second scanning signal terminal Scan2 and initialize the potentials of the gate and the first electrode of the driving transistor DT under the control of the second scanning signal terminal Scan2. Further, the initialization module 12 may transmit a signal of the second electrode of the driving transistor DT to the gate of the driving transistor DT, and transmit a signal of the first initialization signal terminal VREF to the first electrode of the driving transistor DT, under the control of the first scanning signal terminal Scan1 or the first scanning signal terminal Scan1 and the second scanning signal terminal Scan2.

The data writing module 13 is electrically connected to the first scanning signal terminal Scan1 or the second scanning signal terminal Scan2 and the data signal terminal VDATA, for transmitting a signal of the data signal terminal VDATA to the second electrode plate C102 of the first capacitor C1 under the control of the first scanning signal terminal Scan1 or the second scanning signal terminal Scan2.

The light emitting control module 14 is electrically connected to the first light emitting signal terminal Emit1, the second light emitting signal terminal Emit2, the first voltage terminal PVDD and the first and second electrode of the driving transistor DT, for transmitting a potential signal of the first electrode of the driving transistor DT to the second electrode plate 102 of the first capacitor C1 under the control of the first light emitting signal terminal Emit1, and driving the organic light emitting diode D1 to emit light based on the signal of the first voltage terminal PVDD under the control of the second light emitting signal terminal Emit2. A cathode of the organic light emitting diode D1 is electrically connected to the second voltage terminal PVEE.

In the pixel driving circuit 100, on the one hand, the potentials of the second electrode (N4 node) and the gate (N1 node) of the driving transistor DT may be initialized, and then the second electrode (N4 node) and the gate (N1 node) of the driving transistor DT may be controlled and vacated, and charged to a certain potential A to the first electrode (N2 node) of the driving transistor DT through the first initialization signal terminal VREF. The driving transistor DT is then turned on so that the potential at the gate (N1 node) of the driving transistor DT changes. When the potential difference between the gate (N1 node) of the driving transistor DT and the first electrode (N2 node) changes into the threshold voltage Vth of the driving transistor DT, the driving transistor DT is turned off. The first electrode of the driving transistor DT is A+Vth, where A is a value independent of the threshold voltage Vth, and the light emitting current of the organic light emitting diode is positively related to Vgs−Vth, where Vgs is the potential difference between the N1 node and the N2 node. Assuming that the potential at the N2 node is B (B is a value independent of Vth and related to the written data signal) after the data signal is written, the light emitting current is A+Vth−B−Vth=A−B, it can be observed that the light emitting current is independent of the threshold voltage Vth of the driving transistor, i.e., the pixel driving circuit 100 realizes a compensation to the threshold voltage of the driving transistor, so that the impact on the display luminance due to the threshold voltage shift of the driving transistor can be avoided.

On the other hand, in the pixel driving circuit 100, the two electrode plates of the first capacitor C1 are respectively electrically connected to the N1 node and the N3 node, and the coupling of the first capacitor C1 only changes the node position of the N1 node or the N3 node. The N3 node and the N2 node can then be turned off by the light emitting control module 14 to ensure that the organic light emitting diode D1 does not divide the potential change of the N3 node or the N1 node, i.e., the capacitance value of the organic light emitting diode D1 will not affect the potential at the N1 node, N2 node and N3 node in the circuit. The light emitting current of the organic light emitting diode D1 is only related to the potential difference Vgs between the N1 node and the N2 node, and the size of the driving transistor DT, so that the light emitting current of the organic light emitting diode D1 is not affected by the capacitance value thereof, which ensures the accuracy of the display luminance in different pixel driving circuits, thereby improving the uniformity of the display luminance of the organic light emitting display panel.

In addition, the capacitors and transistors in the pixel driving circuit are all non-display devices. The organic light emitting diode is a display device. Usually in order to ensure the normal operation of the pixel driving circuit, the size of the capacitor in the circuit is larger than that of the thin film transistor. The number of the capacitors in the pixel driving circuit 100 is small, and the area occupied by the non-display devices in the pixel driving circuit can be reduced, so that more pixel driving circuits can be arranged per unit area in the panel, thereby enhancing the resolution of the organic light emitting display panel.

Figure 2:
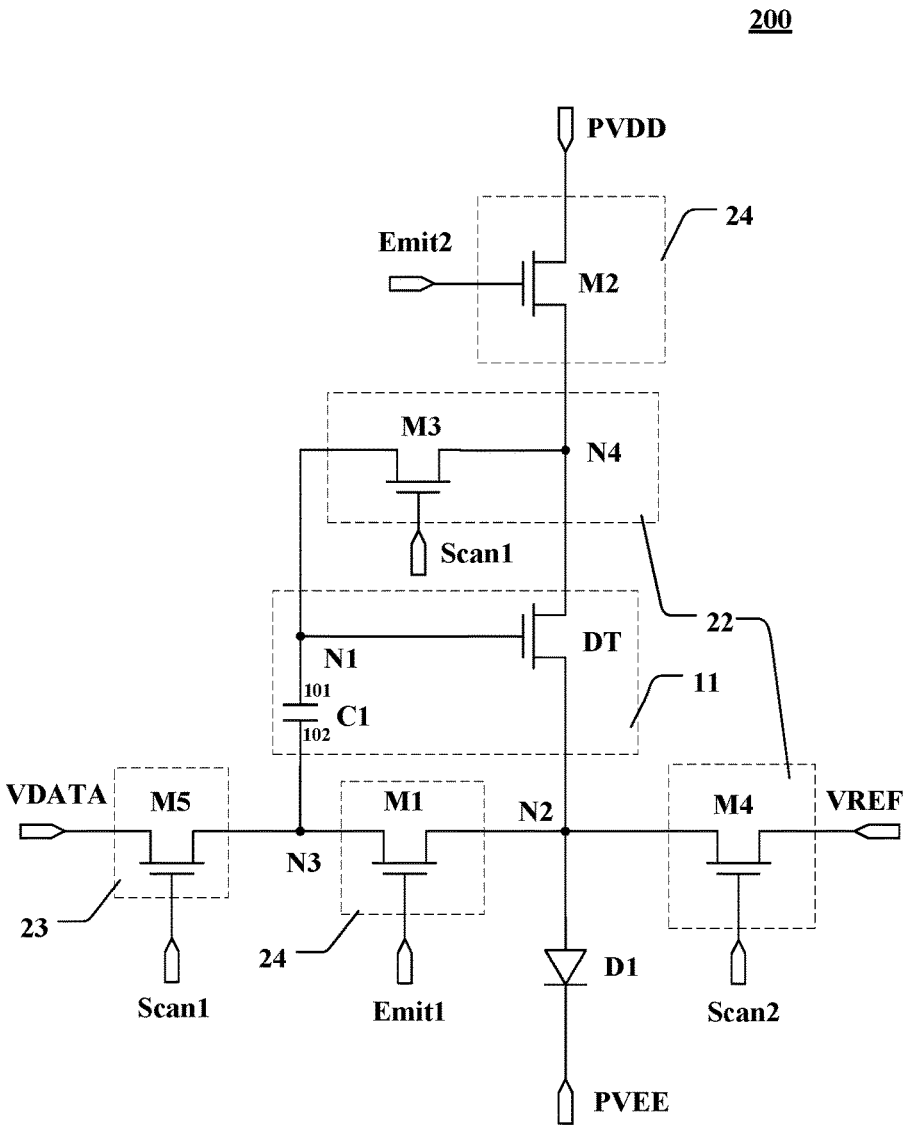
FIG. 2 is a schematic structural diagram of a specific circuit of the pixel driving circuit as shown in FIG. 1.

With further reference to FIG. 2, a schematic structural diagram of a specific circuit of the pixel driving circuit as shown in FIG. 1 is illustrated.

As shown in FIG. 2, the pixel driving circuit 200 of the present embodiment includes a driving module 11, an initialization module 22, a data writing module 23 and a light emitting control module 24, wherein the driving module 11 is identical to the driving module in the pixel driving circuit 100 shown in FIG. 1, and the initialization module 22, the data writing module 23 and the light emitting control module 24 are respectively corresponding to the initialization module 12, the data writing module 13 and the light emitting control module 14 shown in FIG. 2.

Here, the light emitting control module 24 includes a first transistor M1 and a second transistor M2. A gate of the first transistor M1 is electrically connected to the first light emitting signal terminal Emit1. A first electrode of the first transistor M1 is electrically connected to the first electrode (N2 node) of the driving transistor DT. A second electrode of the first transistor M1 is electrically connected to the second electrode plate 102 of the first capacitor C1. A gate of the second transistor M2 is electrically connected to the second light emitting signal terminal Emit2. A first electrode of the second transistor M2 is electrically connected to the first voltage terminal PVDD. A second electrode of the second transistor M2 is electrically connected to the second electrode (N4 node) of the driving transistor DT.

In the present embodiment, the initialization module 22 includes a third transistor M3 and a fourth transistor M4, and for initializing the potentials of the first electrode (N2) and the gate (N1) of the driving transistors DT under the control of the first scanning signal terminal Scan1 and the second scanning signal terminal Scan2. The third transistor M3 may initialize the gate (N1 node) of the driving transistor DT at the same potential as the second electrode (N4 node) of the driving transistor under the control of the first scanning signal terminal Scan1. Specifically, a gate of the third transistor M3 is electrically connected to the first scanning signal terminal Scan1. A first electrode of the third transistor M3 is electrically connected to the second electrode (N4 node) of the driving transistor DT. A second electrode of the third transistor M3 is electrically connected to the gate (N1 node) of the driving transistor DT. The fourth transistor M4 may transmit a signal of the first initialization signal terminal VREF to the first electrode (N2 node) of the driving transistor DT under the control of the second scanning signal terminal Scan2. Specifically, a gate of the fourth transistor M4 is electrically connected to the second scanning signal terminal Scan2. A first electrode of the fourth transistor M4 is electrically connected to the first initialization signal terminal VREF. A second electrode of the fourth transistor M4 is electrically connected to the first electrode (N2 node) of the driving transistor DT.

The data writing module 23 includes a fifth transistor M5 for transmitting a signal of the data signal terminal VDATA to the second electrode plate 102 of the first capacitor C1 under the control of the first scanning signal terminal Scan1. Specifically, a gate of the fifth transistor M5 is electrically connected to the first scanning signal terminal Scan1. A first electrode of the fifth transistor M5 is electrically connected to the data signal terminal VDATA. A second electrode of the fifth transistor M5 is electrically connected to the second electrode plate 102 of the first capacitor C1.

The first electrode (N2 node) of the driving transistor DT is electrically connected to the anode of the organic light emitting diode D1. The cathode of the organic light emitting diode D1 is electrically connected to the second voltage terminal PVEE, so that when a potential difference between the N2 node and the second voltage terminal PVEE is higher than a break-over voltage of the organic light emitting diode D1, the organic light emitting diode D1 emits light.

In the pixel driving circuit 200, the two electrode plates 101 and 102 of the first capacitor C1 are respectively connected to the gate (N1 node) of the driving transistor and the first electrode (N3 node) of the first transistor M1. Therefore, when the potential at the N1 node changes, the potential at the N3 node changes under the coupling of the first capacitor C1, and the first transistor M1 can then be controlled to be turned off so that the potential at the N2 node does not change, and the organic light emitting diode D1 does not divide the potential change of the N3 node. Thus, the capacitance of the organic light emitting diode D1 will not affect the potential at each node (N1, N2, N3, N4) in the pixel driving circuit, and the light emitting current of the organic light emitting diode D1 is not affected by the capacitance value thereof, which ensures the accuracy of the display luminance in different pixel driving circuits.

Figure 3:
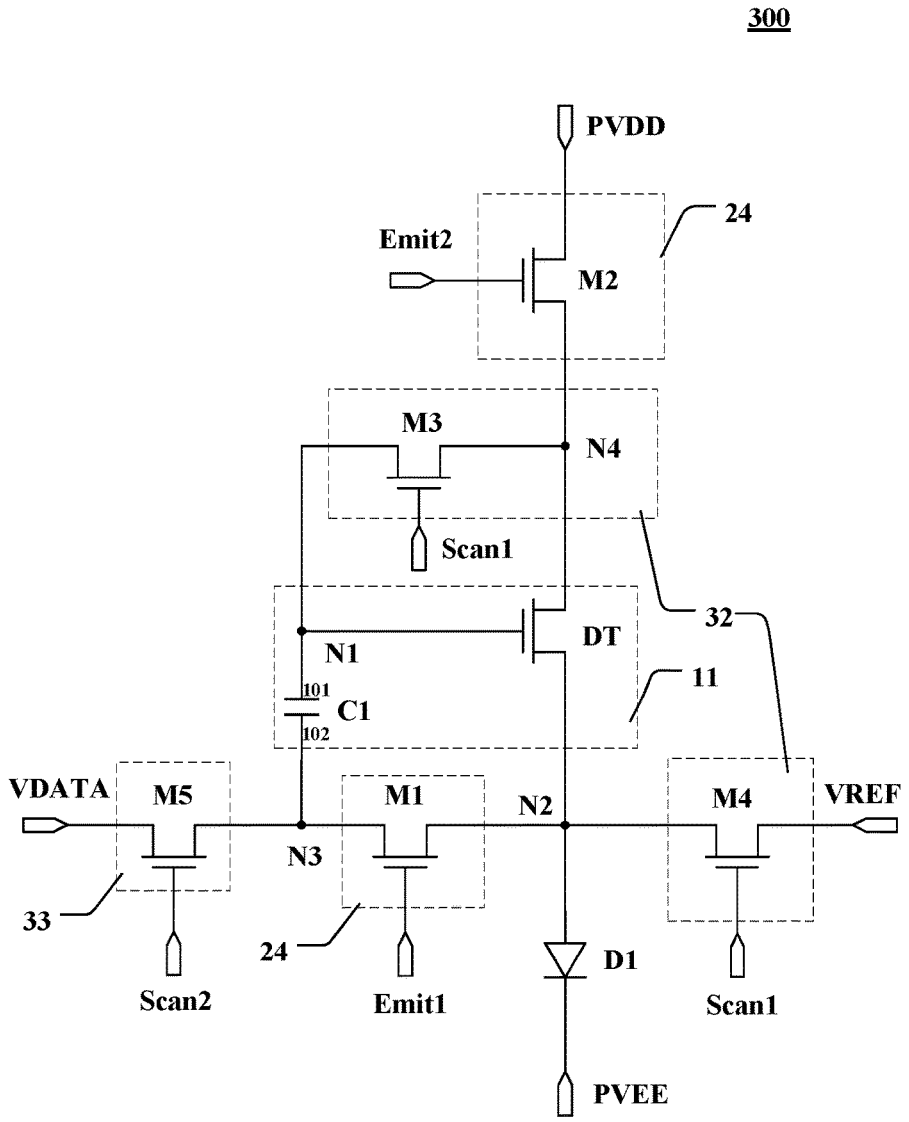
FIG. 3 is a schematic structural diagram of another specific circuit of the pixel driving circuit as shown in FIG. 1.

With further reference to FIG. 3, a schematic structural diagram of another specific circuit of the pixel driving circuit as shown in FIG. 1 is illustrated.

As shown in FIG. 3, the pixel driving circuit 300 includes an initialization module 32, a data writing module 33, a driving module 11 which is identical to the one in the pixel driving circuit 100 shown in FIG. 1 and a light emitting control module which is identical to the one in the pixel driving circuit 200 shown in FIG. 2.

In the present embodiment, the initialization module 32 includes a third transistor M3 and a fourth transistor M4, and for initializing the potentials of the first electrode (N2) and the gate (N1) of the driving transistors DT under the control of the first scanning signal terminal Scan1. The third transistor M3 may initialize the gate (N1 node) of the driving transistor DT at the same potential as the second electrode (N4 node) of the driving transistor under the control of the first scanning signal terminal Scan1. Specifically, the gate of the third transistor M3 is electrically connected to the first scanning signal terminal Scan1. The first electrode of the third transistor M3 is electrically connected to the second electrode (N4 node) of the driving transistor DT. The second electrode of the third transistor M3 is electrically connected to the gate (N1 node) of the driving transistor DT. The fourth transistor M4 may transmit a signal of the first initialization signal terminal VREF to the first electrode (N2 node) of the driving transistor DT under the control of the first scanning signal terminal Scan1. Specifically, the gate of the fourth transistor M4 is electrically connected to the first scanning signal terminal Scan1. The first electrode of the fourth transistor M4 is electrically connected to the first initialization signal terminal VREF. The second electrode of the fourth transistor M4 is electrically connected to the first electrode (N2 node) of the driving transistor DT.

The data writing module 33 includes a fifth transistor M5 for transmitting a signal of the data signal terminal VDATA to the second electrode plate 102 of the first capacitor C1 under the control of the first scanning signal terminal Scan1. Specifically, the gate of the fifth transistor M5 is electrically connected to the first scanning signal terminal Scan1. The first electrode of the fifth transistor M5 is electrically connected to the data signal terminal VDATA. The second electrode of the fifth transistor M5 is electrically connected to the second electrode plate 102 of the first capacitor C1.

As can be observed from FIG. 3, unlike the pixel driving circuit 200 shown in FIG. 2, in the pixel driving circuit 300 of the present embodiment, the fourth transistor M4 is controlled to be turned on or off by the first scanning signal terminal Scan1 and the fifth transistors M5 is turned on or off by the second scanning signal terminal Scan2, i.e., the third transistor M3 and the fourth transistor M4 in the initialization module 32 in the pixel driving circuit 300 may be turned on or off at the same time. When the potentials of the gate (N1 node) and the first electrode (N2 node) of the driving transistor DT is initialized at different times, at some point the potential at the N1 node or the N2 node may be unstable, which may lead to an unstable operation state of the driving transistor DT. In the present embodiment, the third transistor M3 and the fourth transistor M4 are both controlled by the first scanning signal terminal Scan1, so that the potentials of the N1 node and the N2 node are simultaneously initialized, therefore the unstable operation state of the driving transistor DT due to the instability of the node potential during the initialization process can be avoided and the reliability of the pixel driving circuit can be improved.

In addition, the data writing module 33 and the initialization module 32 in the pixel driving circuit shown in FIG. 3 are controlled by different scanning signal terminals, therefore the control of the initialization module 32 and the control of the data writing module 33 are not related to each other, which enhances the flexibility of controlling the pixel driving circuit for initializing and data writing.

Figure 4:
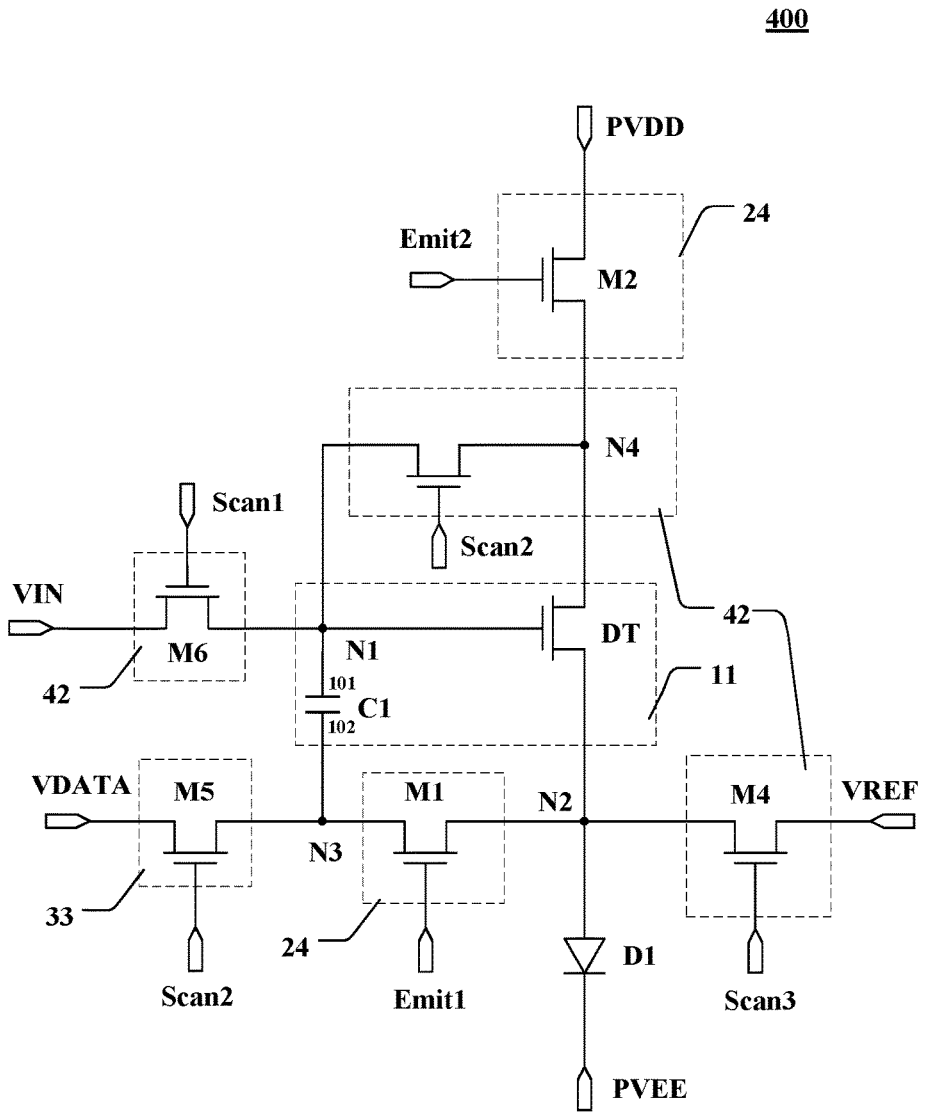
FIG. 4 is a schematic structural diagram of another specific circuit of the pixel driving circuit as shown in FIG. 1.

With further reference to FIG. 4, a schematic structural diagram of another specific circuit of the pixel driving circuit as shown in FIG. 1 is illustrated.

As shown in FIG. 4, the pixel driving circuit 400 includes an initialization module 42, a driving module 11 which is identical to that in the pixel driving circuit 100, a light emitting control module 24 which is identical to that in the pixel driving circuit 200 and a data writing module 33 which is identical to that in the pixel driving circuit 300.

In the present embodiment, the pixel driving circuit 400 further includes a third scanning signal terminal Scan3 and a second initialization signal terminal VIN. The initialization module 42 includes a third transistor M3, a fourth transistor M4 and a sixth transistor M6. The initialization module 42 is for initializing the potentials of the gate (N1 node) and the first electrode (N2) of the driving transistor under the control of the first scanning signal terminal Scan1, the second scanning signal terminal Scan2, and the third scanning signal terminal Scan3. Specifically, the gate of the third transistor M3 is electrically connected to the second scanning signal terminal Scan2. The first electrode of the third transistor M3 is electrically connected to the second electrode (N4 node) of the driving transistor DT. The second electrode of the third transistor M3 is electrically connected to the gate (N1 node) of the driving transistor DT. The gate of the fourth transistor M4 is electrically connected to the third scanning signal terminal Scan3. The first electrode of the fourth transistor M4 is electrically connected to the first initialization signal terminal VREF. The second electrode of the fourth transistor M4 is electrically connected to the first electrode of the driving transistor DT. A gate of the sixth transistor M6 is electrically connected to the first scanning signal terminal Scan1. A first electrode of the sixth transistor M6 is electrically connected to the second initialization signal terminal VIN. A second electrode of the sixth transistor M6 is electrically connected to the gate (N1 node) of the driving transistor DT.

As can be observed from FIG. 4, unlike the pixel driving circuit 300 shown in FIG. 3, the initialization module 42 in the present embodiment adds the sixth transistor M6 and the second initialization signal terminal VIN for initializing the gate (N1 node) of the driving transistor DT. The potential at the N1 node in the pixel driving circuit 300 shown in FIG. 3 is initialized by the N4 node under the control of the first scanning signal terminal Scan1, and the N4 node is controlled by the second light emitting signal terminal Emit2 to receive the signal of the first voltage terminal PVDD. As can be observed that the N4 node may be in an unstable state when the potential at the N1 node is initialized, therefore the potential at the N1 node is also not stable at the time of initialization. The pixel driving circuit 400 of the present embodiment may provide a stable initializing potential to the N1 node by using the sixth transistor M6 and the second initialization signal terminal VIN, which further improves the stability of the operation state of the pixel driving circuit as compared with the embodiments shown in FIGS. 2 and 3, and thus ensuring the stability of the display luminance.

Since the number of capacitors in the pixel driving circuits described above with reference to the FIGS. 2, 3, and 4 is 1, the area occupied by each of the pixel driving circuits is small, which facilitates the design of the high-resolution display panel.

Figure 5:
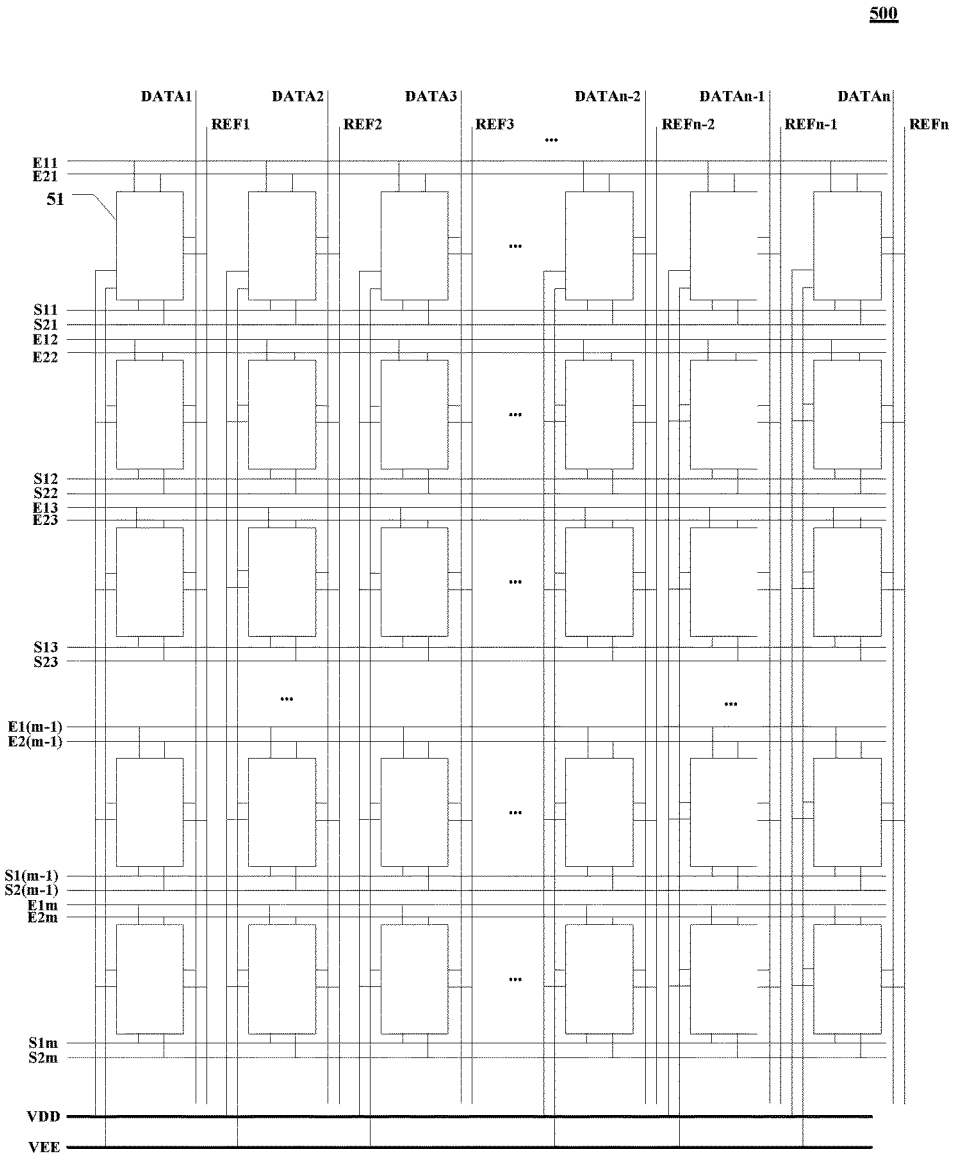
FIG. 5 is a schematic structural diagram of an embodiment of the organic light emitting display panel according to the present disclosure.

With reference to FIG. 5, a schematic structural diagram of an embodiment of the organic light emitting display panel according to the present disclosure is illustrated.

As shown in FIG. 5, the organic light emitting display panel 500 may include pixel driving circuits 51 arranged in an array. The pixel driving circuit 51 may be any one of the pixel driving circuits shown in the above FIGS. 1 to 3.

The organic light emitting display panel 500 further includes a plurality of first scanning signal lines S11, S12, S13, S1 (*m*−1), S1*m*, a plurality of second scanning signal lines S21, S22, S23, S2 (*m*−1), S2*m*, a plurality of first light emitting signal lines E11, E12, E13, E1 (*m*−1), E1*m*, a plurality of second light emitting signal lines E21, E22, E23, E2 (*m*−1), E2*m*, a plurality of data signal lines DATA1, DATA2, DATA3, . . . , DATA (n−2), DATA (n−1), DATAn, at least one first initialization signal line REF1, REF2, REF3, . . . , REF (n−2), REF (n−1), REFn, a first voltage signal line VDD and a second voltage signal line VEE, wherein m and n are positive integers.

The first scanning signal terminal Scan1 of each pixel driving circuit 51 is electrically connected to a first scanning signal line S11, S12, S13, S1 (*m*−1) or S1*m*. The second scanning signal terminal Scan2 of each pixel driving circuit 51 is electrically connected to a second scanning signal line S21, S22, S23, S2 (*m*−1) or S2*m*. The first light emitting signal terminal Emit1 of each pixel driving circuit 51 is electrically connected to a first light emitting signal line E11, E12, E13, E1 (*m*−1) or E1*m*. The second light emitting signal terminal Emit2 of each pixel driving circuit 51 is electrically connected to a second light emitting signal line E21, E22, E23, E2 (*m*−1) or E2*m*. The data signal terminal VDATA of each pixel driving circuit 51 is electrically connected to a data signal line DATA1, DATA2, DATA3, . . . , DATA (n−2), DATA (n−1) or DATAn. The first initialization signal terminal VREF of each pixel driving circuit 51 is electrically connected to a first initialization signal line REF1, REF2, REF3, . . . , REF (n−2), REF(n−1) or REFn. The first voltage terminal PVDD of each pixel driving circuit 51 is electrically connected to a first voltage signal line VDD. The second voltage terminal PVEE of each pixel driving circuit 51 is electrically connected to a second voltage signal line VEE.

Further, in some alternative implementations of the present embodiment, as shown in FIG. 5, each of the first scanning signal lines S11, S12, S13, S1 (*m*−1) or S1*m* is respectively electrically connected to the first scanning signal terminal Scan1 of a row of pixel driving circuits 51. Each of the second scanning signal lines S21, S22, S23, S2 (*m*−1) or S2*m* is respectively electrically connected to the second scanning signal terminal Scan2 of a row of pixel driving circuits 51. Each of the first light emitting signal lines E11, E12, E13, E1 (*m*−1) or E1*m* is respectively electrically connected to the first light emitting signal terminal Emit1 of a row of pixel driving circuits 51. Each of the second light emitting signal lines E21, E22, E23, E2 (*m*−1) or E2*m* is respectively electrically connected to the second light emitting signal terminal Emit2 of a row of pixel driving circuits 51. Each of the data signal lines DATA1, DATA2, DATA3, . . . , DATA (n−2), DATA (n−1) or DATAn is respectively electrically connected to the data signal terminal VDATA of a column of pixel driving circuits 51. Each of the first initialization signal lines REF1, REF2, REF3, . . . , REF (n−2), REF (n−1) or REFn is respectively electrically connected to the first initialization signal terminal VREF of a column of pixel driving circuits 51. The first voltage terminal PVDD of each pixel driving circuit 51 is electrically connected to the first voltage signal line VDD, and the second voltage terminal PVEE of each pixel driving circuit 51 is electrically connected to the second voltage signal line PVEE.

The display luminance of each sub-pixel may not be the same when displaying the screen, so that the emission luminance of the organic light emitting diodes are different, and the data signals received by the pixel driving circuits are different. When a plurality of pixel driving circuits are connected to a data signal line, the data signal line needs to transmit different data signals respectively to different pixel driving circuits at different times. Typically, the pixel driving circuits 51 located on the same row are simultaneously driven, and the organic light emitting diodes of the pixel driving circuits 51 located on the same row emit light simultaneously, so that the organic light emitting diodes in the pixel driving circuit array may be lit line by line to complete the display of the entire screen. The present embodiment utilizes a data line to connect a column of pixel driving circuits, which can provide different data signals to the pixel driving circuits located in different columns through the data lines when each row of the pixel driving circuits 51 are driven. Since the pixel driving circuits of different rows do not operate simultaneously and the pixel driving circuits 51 connected to the data line are located at mutually different rows, the organic light emitting display panel 500 provided by the present embodiment can display by each of the data lines driving a column of sub-pixels, and the signals on the data lines do not need to be changed during the period of driving the operation of a row of pixel driving circuits, thereby the load of the drive IC (Integrated Circuit) for providing the data signal to the data signal line can be reduced.

Figure 6:
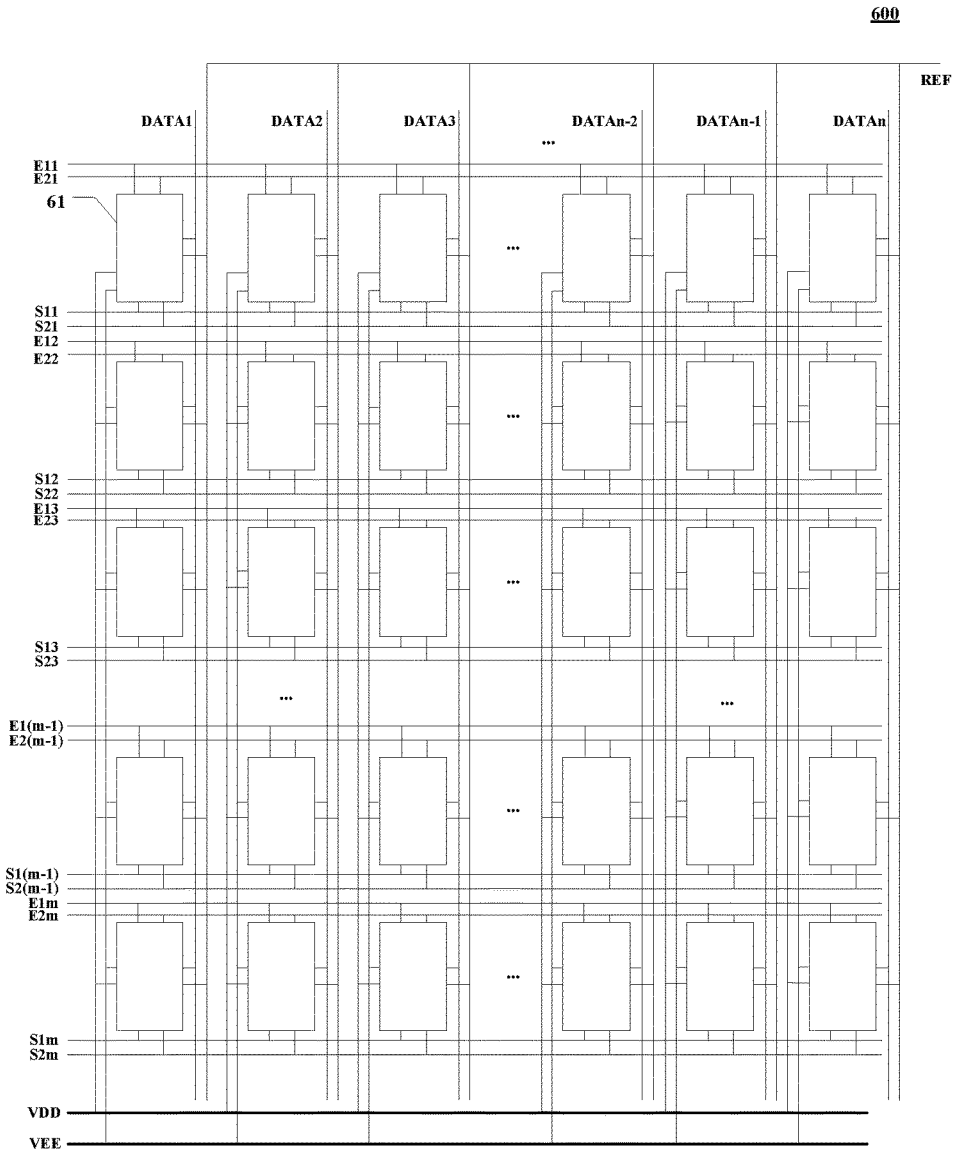
FIG. 6 is a schematic structural diagram of another embodiment of the organic light emitting display panel according to the present disclosure.

With reference to FIG. 6, a schematic structural diagram of another embodiment of the organic light emitting display panel according to the present disclosure is illustrated. Unlike the embodiment shown in FIG. 5, the organic light emitting display panel 600 in the present embodiment includes only one first initialization signal line REF, and the first initialization signal terminal VREF of each pixel driving circuit 61 is electrically connected to a common first initialization signal line REF. Typically, the first initialization signal line may be directly connected to the port of the drive IC. Compared with the embodiment shown in FIG. 5, the organic light emitting display panel 600 shown in FIG. 6 reduces the number of the first initialization signal lines connected to the drive IC and the number of ports of the drive IC occupied, which may simplify the port design of the IC.

Figure 7:
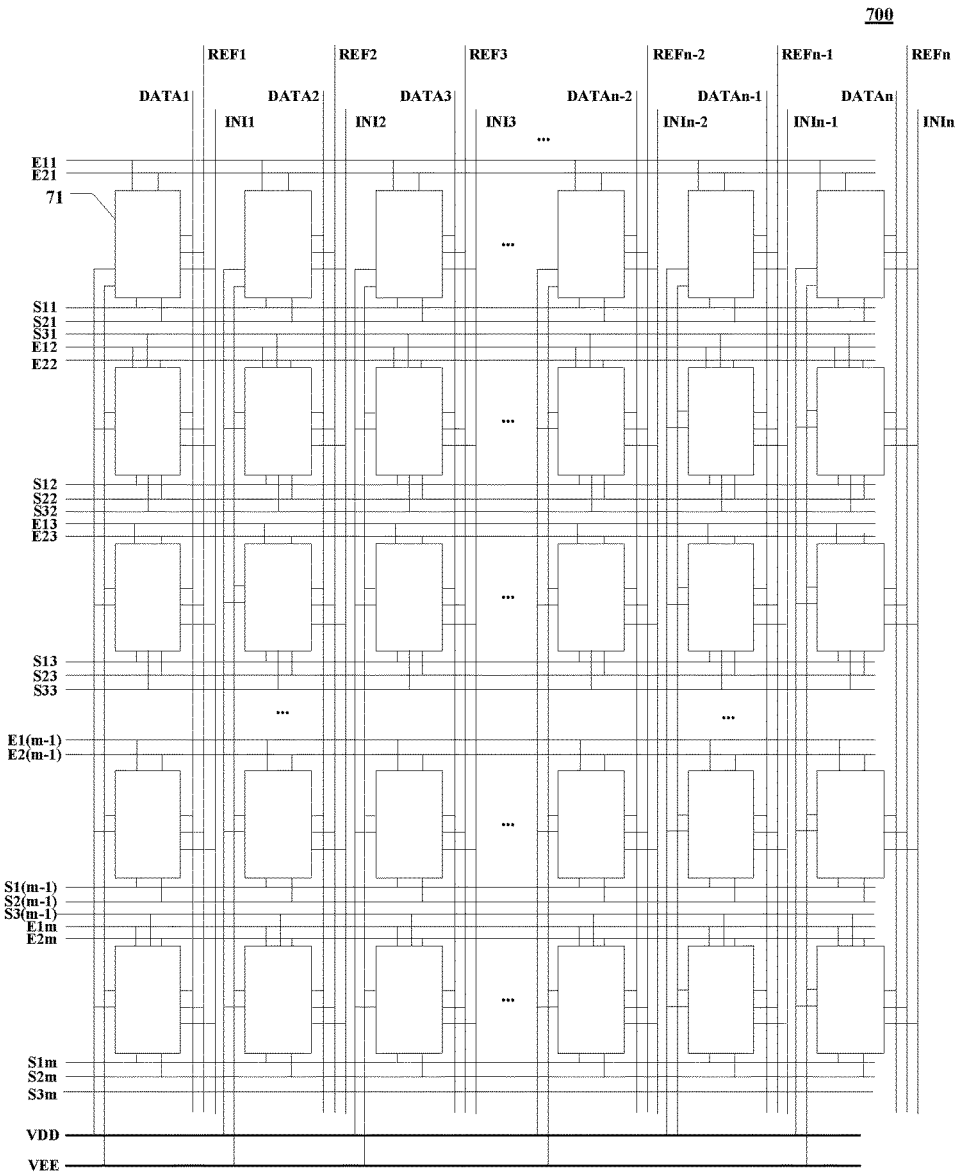
FIG. 7 is a schematic structural diagram of another embodiment of the organic light emitting display panel according to the present disclosure.

With further reference to FIG. 7, a schematic structural diagram of another embodiment of the organic light emitting display panel according to the present disclosure is illustrated.

As shown in FIG. 7, the organic light emitting display panel 500 may include pixel driving circuits 71 arranged in an array. The pixel driving circuit 71 may be the pixel driving circuit 400 shown in the above FIG. 4.

The organic light emitting display panel 700 further includes a plurality of first scanning signal lines S11, S12, S13, S1 (*m*−1), S1*m*, a plurality of second scanning signal lines S21, S22, S23, S2 (*m*−1), S2*m*, a plurality of third scanning signal lines S31, S32, S33, S3 (*m*−1), S3*m*, a plurality of first light emitting signal lines E11, E12, E13, E1 (m−1), E1m, a plurality of second light emitting signal lines E21, E22, E23, E2 (m−1), E2m, a plurality of data signal lines DATA1, DATA2, DATA3, . . . , DATA (n−2), DATA (n−1), DATAn, at least one first initialization signal line REF1, REF2, REF3, . . . , REF (n−2), REF (n−1), REFn, at least one second initialization signal line INI1, INI2, INI3, . . . INI (n−2), INI (n−1), INIn, a first voltage signal line VDD and a second voltage signal line VEE, wherein m and n are positive integers.

Each pixel driving circuit 71 includes a first scanning signal terminal Scan1, a second scanning signal terminal Scan2, a third scanning signal terminal Scan3, a first initialization signal terminal VREF, a second initialization signal terminal VIN, a first light emitting signal terminal Emit1, a second light emitting signal terminal Emit2, a first voltage terminal PVDD and a second voltage terminal PVEE. The first scanning signal terminal Scan1 of each pixel driving circuit 71 is electrically connected to a first scanning signal line S11, S12, S13, S1 (m−1) or S1m. The second scanning signal terminal Scan2 of each pixel driving circuit 71 is electrically connected to a second scanning signal line S21, S22, S23, S2 (m−1) or S2m. The third scanning signal terminal Scan3 of each pixel driving circuit 71 is electrically connected to a third scanning signal line S31, S32, S33, S3 (m−1) or S3m. The first light emitting signal terminal Emit1 of each pixel driving circuit 71 is electrically connected to a first light emitting signal line E11, E12, E13, E1 (m−1) or E1m. The second light emitting signal terminal Emit2 of each pixel driving circuit 71 is electrically connected to a second light emitting signal line E21, E22, E23, E2 (m−1) or E2m. The data signal terminal VDATA of each pixel driving circuit 71 is electrically connected to a data signal line DATA1, DATA2, DATA3, . . . , DATA (n−2), DATA (n−1) or DATAn. The first initialization signal terminal VREF of each pixel driving circuit 71 is electrically connected to a first initialization signal line REF1, REF2, REF3, . . . , REF (n−2), REF(n−1) or REFn. The second initialization signal terminal VIN of each pixel driving circuit 71 is electrically connected to a second initialization signal line INI1, INI2, INI3, . . . , INI (n−2), INI(n−1) or INIn. The first voltage terminal PVDD of each pixel driving circuit 71 is electrically connected to a first voltage signal line VDD. The second voltage terminal PVEE of each pixel driving circuit 71 is electrically connected to a second voltage signal line VEE.

Further, in some alternative implementations of the present embodiment, as shown in FIG. 7, each of the first scanning signal lines S11, S12, S13, S1 (m−1) or S1m is respectively electrically connected to the first scanning signal terminal Scan1 of a row of pixel driving circuits 71. Each of the second scanning signal lines S21, S22, S23, S2 (m−1) or S2m is respectively electrically connected to the second scanning signal terminal Scan2 of a row of pixel driving circuits 71. Each of the third scanning signal lines S31, S32, S33, S3 (m−1) or S3m is respectively electrically connected to the third scanning signal terminal Scan2 of a row of pixel driving circuits 71. Each of the first light emitting signal lines E11, E12, E13, E1 (m−1) or E1m is respectively electrically connected to the first light emitting signal terminal Emit1 of a row of pixel driving circuits 71. Each of the second light emitting signal lines E21, E22, E23, E2 (m−1) or E2m is respectively electrically connected to the second light emitting signal terminal Emit2 of a row of pixel driving circuits 71. Each of the data signal lines DATA1, DATA2, DATA (n−2), DATA (n−1) or DATAn is respectively electrically connected to the data signal terminal VDATA of a column of pixel driving circuits 71. Each of the first initialization signal lines REF1, REF2, REF3, . . . , REF (n−2), REF (n−1) or REFn is respectively electrically connected to the first initialization signal terminal VREF of a column of pixel driving circuit 71. Each of the second initialization signal lines INI1, INI2, INI3, . . . , INI (n−2), INI (n−1) or INIn is respectively electrically connected to the second initialization signal terminal VIN of a column of pixel driving circuit 71. The first voltage terminals PVDD of each of the pixel driving circuits 71 are electrically connected to the first voltage signal line VDD, and the second voltage terminals PVEE of each of the pixel driving circuits 71 are electrically connected to the second voltage signal line PVEE. Based on this connection mode, when driving the organic light emitting display panel 700 to display, it is possible to drive each row of pixel driving circuits to operate simultaneously, and here data signals are provided from each of the data signal lines to the pixel driving circuits located in different columns. The pixel driving circuits of different rows do not operate simultaneously, so that the signal transmitted by the data signal line in the time period during which a row of pixel driving circuits are operated is a signal possessing a stable level, and a display error is less likely to occur.

Alternatively, in some embodiments, the first initialization signal terminals VREF of each of the pixel driving circuits 71 are connected to a common first initialization signal line, and the second initialization signal terminals VREF of each of the pixel driving circuits 71 are connected to a common second initialization signal line, reducing the number of signal lines connected to the driver IC and simplifing the port design of the driver IC.

FIGS. 5 to 7 only schematically show the connection relationship between each signal line and the pixel driving circuit in the organic light emitting display panel of the present disclosure. In other embodiments of the present disclosure, the plurality of pixel driving circuits connected to each data signal line may be located in different columns. The plurality of pixel driving circuits connected to each first scanning signal line may be located in different rows. The pixel driving circuits connected to each second scanning signal line may be located in different rows. The plurality of pixel driving circuits connected to each first light emitting signal line may be located in different rows. The plurality of pixel driving circuits connected to each second light emitting signal line may be located in different rows. The number of the first voltage signal lines and the second voltage signal lines may be plural.

It should be noted that the first transistor M1, the second transistor M2, the third transistor M3, the fourth transistor M4, the fifth transistor M5, and the driving transistor DT in the above embodiments may each be a N-type transistor or a P-type transistor. When the driving transistor DT is a N-type transistor, its threshold voltage Vth>0. When the driving transistor is a P-type transistor, its threshold voltage Vth<0.

The present disclosure also provides a driving method applied to each of the embodiments of the above organic light emitting display panel. In the driving method, the operation process of each pixel driving circuit includes at least four phases.

Specifically, in a first phase, a first level signal is provided to the first scanning signal terminal and the second light emitting signal terminal, a second level signal is provided to the first light emitting signal terminal, a first data signal is provided to the data signal terminal, the potentials of the gate of the driving transistor and the second electrode of the driving transistor are initialized by the initialization module.

In a second phase, the second level signal is provided to the first light emitting signal terminal and the second light emitting signal terminal, the first level signal is provided to the second scanning signal terminal, a first initialization signal is provided to the first initialization signal terminal, the first initialization signal is transmitted to the first electrode of the driving transistor by the initialization module.

In a third phase, the first level signal is provided to the first light emitting signal terminal, the potential at the gate of the driving transistor is raised or lowered under the coupling of the first capacitor.

In a fourth phase, the first level signal is provided to the first light emitting signal terminal and the second light emitting signal terminal, the second level signal is provided to the first scanning signal terminal and the second scanning signal terminal, the organic light emitting diode emits light based on the potential difference between the gate and the first electrode of the driving transistor.

Figure 8:
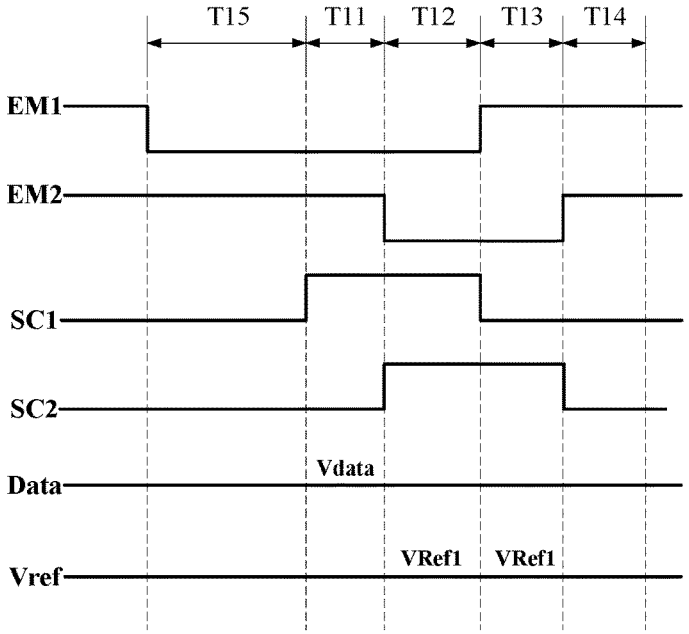
FIG. 8 is a schematic diagram of the operation timing sequence of the pixel driving circuit as shown in FIG. 2.
Figure 9:
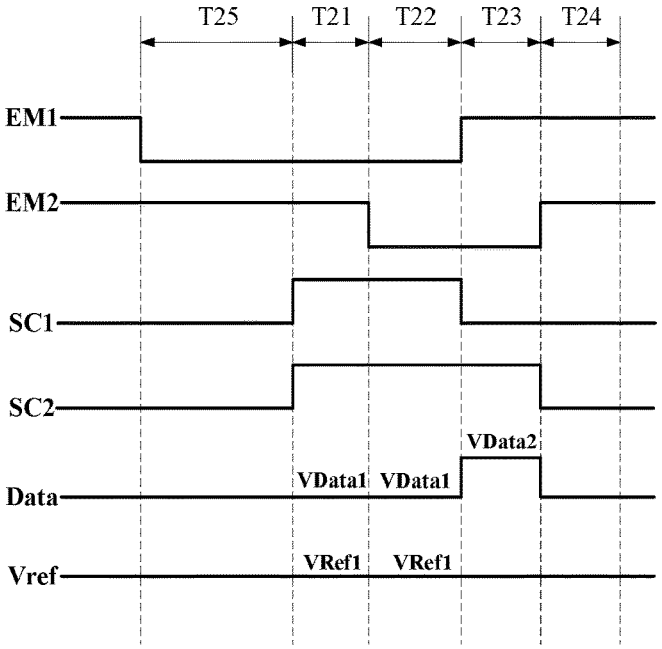
FIG. 9 is a schematic diagram of the operation timing sequence of the pixel driving circuit as shown in FIG. 3.
Figure 10:
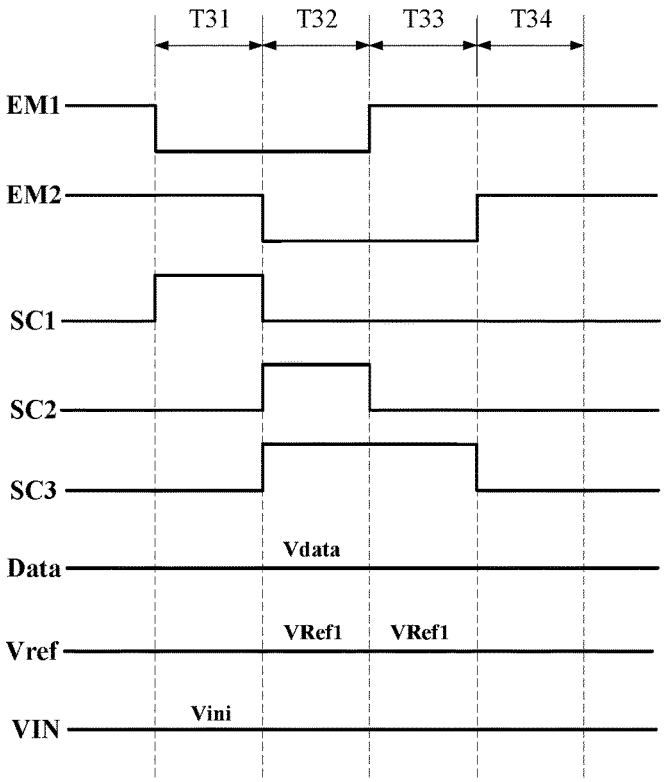
FIG. 10 is a schematic diagram of the operation timing sequence of the pixel driving circuit as shown in FIG. 4.
Figure 11:
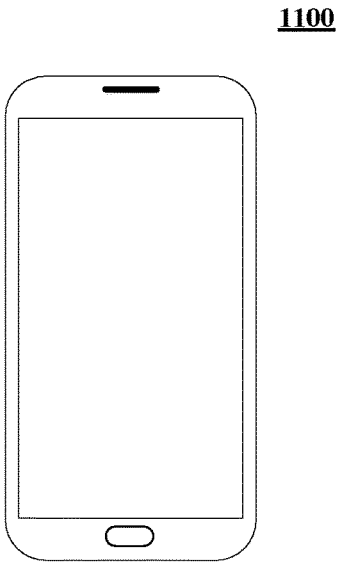
FIG. 11 is a schematic diagram of an organic light emitting display apparatus disclosed by the present disclosure.

Based on that the first transistor M1, the second transistor M2, the third transistor M3, the fourth transistor M4, the fifth transistor M5, the sixth transistor M6 and the driving transistor DT in the above embodiments are all N-type transistors, the first level signal in the driving method is a high level signal, and the second level signal is a low level signal, the operation principle of each pixel driving circuit driven by the driving method will be further described below with reference to FIGS. 8, 9 and 10. Here, SC1, SC2, SC3, EM1, EM2, Data, Vref and Vini denote to signals provided respectively to the first scanning signal terminal Scan1, the second scanning signal terminal Scan2, the third scanning signal terminal Scan3, the first light emitting signal terminal Emit1, the second light emitting signal terminal Emit2, the data signal terminal VDATA, the first initialization signal terminal VREF and the second initialization signal terminal VIN. Here, the high level and the low level represent only the relative relationship between the levels, and are not particularly limited to a certain level signal. The high level signal may be a signal for turning on the first to the sixth transistors, and the low level signal may be a signal for turning off the first to the sixth transistors.

With reference to FIG. 8, a schematic diagram of the operation timing sequence of the pixel driving circuit as shown in FIG. 2 is illustrated.

For the pixel driving circuit 200 shown in FIG. 2, in the first phase T11, a first level signal is provided to the first scanning signal terminal Scan1 and the second light emitting signal terminal Emit2. A second level signal is provided to the first light emitting signal terminal Emit1 and the second scanning signal terminal Scan2. The first data signal Vdata is provided to the data signal terminal. The second transistor M2 and the third transistor M3 are turned on. A signal VPVDD of the first voltage terminal PVDD is transmitted to the second electrode (N2 node) and gate (N1 node) of the driving transistor DT. The fifth transistor M5 is turned on. The first data signal Vdata is written to the second electrode plate 102 (N3 node) of the first capacitor C1, where the potential VN1 of the N1 node is equal to the potential VN4 of the N4 node, VN1=VN4=$V_{PVDD}$, the potential at the N3 node VN3=Vdata.

In the second phase T12, the second level signal is provided to the first light emitting signal terminal Emit1 and the second light emitting signal terminal Emit2. The first level signal is provided to the first scanning signal terminal Scan1 and the second scanning signal terminal Scan2. The first initialization signal VRef1 is provided to the first initialization signal terminal VREF. The fourth transistor M4 is turned on. The first initialization signal VRef1 is transmitted to the N2 node. The third transistor and the fifth transistor are turned on. When the voltage value of the first initializing signal VRef1 is low and the sum of the voltage value of the first initialization signal VRef1 and the threshold voltage Vth of the driving transistor DT is less than the potential $V_{PVDD}$ of the N1 node at the first phase T11, the driving transistor DT is turned on. Since the potential at the first electrode (N2 node) of the driving transistor DT remains as VRef1 in the present phase and the N1 node is in a vacated state in the present phase, the potential at the N1 node drops. Until the potential VN1 of the N1 node drops to VRef1+Vth, the driving transistor DT is turned off. At this time, the potential at the N1 node VN1=VRef1+Vth, the potential at the N3 node VN3=Vdata, the potential at the N2 node VN2=VRef1.

In the third phase T13, the first level signal is provided to the first light emitting signal terminal Emit1 and the second light emitting signal terminal Emit2. The second level signal is provided to the first scanning signal terminal Scan1 and the second scanning signal terminal Scan2. The first initialization signal VRef1 is provided to the first initialization signal terminal VREF. The first transistor is turned on. The potential VN3 of the N3 node changes from Vdata of the second phase T12 to VRef1. Under the coupling of the first capacitor C1, the potential change of the N1 node is identical to that of the N3 node, both of which are VRef1−Vdata. Here, the potential at the N1 node is VN1=VRef1+Vth+VRef1−Vdata, and the potential at the N2 node is VRef1.

In the fourth phase T14, the first level signal is provided to the first light emitting signal terminal Emit1 and the second light emitting signal terminal Emit2. The second level signal is provided to the first scanning signal terminal Scan1 and the second scanning signal terminal Scan2. The organic light emitting diode D1 emits light according to a voltage difference between the gate (N1 node) of the driving transistor DT and the first electrode (N2 node) of the driving transistor DT. At this time, the source of the driving transistor DT is the N2 node, and the gate source voltage difference of the driving transistor is Vgs=$V_{N1}$−$V_{N2}$=2□VRef1+Vth−Vdata−VRef1=VRef1+Vth−Vdata. The light emitting current Ids of the organic light emitting diode D1 can be calculated using the following equation (1):

$$\begin{aligned} i)\quad Ids &= K\square(Vgs - |Vth|)^2 \\ &= K\square(VRef1 + Vth - Vdata - Vth)^2 \\ &= K\square(VRef1 - Vdata)^2 \end{aligned} \tag{1}$$

Here, K is the ratio of the width and the length of the channel of the driving transistor DT, a related coefficient of capacitance per unit area of the driving transistor DT. As can be observed from the equation (1), the light emitting current Ids of the organic light emitting diode D1 is independent of the threshold voltage Vth of the driving transistor DT, thereby the pixel driving circuit 200 shown in FIG. 2 realizes a compensation to the threshold voltage of the driving transistor. In addition, the light emitting current of the organic light emitting diode D1 is independent of the capacitance values of the first capacitor C1 and the organic light emitting diode D1, which eliminates the impact of the capacitance value of the organic light emitting diode D1 on the display luminance, thereby avoiding the impact of the organic light emitting diode D1 on the display luminance uniformity. In this case, the organic light emitting diode D1 in different pixel driving circuits on the display panel displays the same luminance when receiving the same data signal, so that the display effect can be improved.

Alternatively, before the first phase T11, the fifth phase T15 may be included. In the fifth phase T15, the first level signal may be provided to the second light emitting signal terminal Emit2, and the second level signal may be provided to the first light emitting signal terminal Emit1, the first scanning signal terminal Scan1 and the second scanning signal terminal Scan2 to turn on the second transistor M2 to initialize the potential at the second electrode (N4 node) of the driving transistor DT to $V_{PVDD}$, so that the potential at the N1 node may rapidly rise to $V_{PVDD}$ after the first level signal is provided to the first scanning signal terminal Scan1 in the above first phase.

With further reference to FIG. 9, a schematic diagram of the operation timing sequence of the pixel driving circuit as shown in FIG. 3 is illustrated.

As shown in FIG. 9, for the pixel driving circuit 300 shown in FIG. 3, in the first phase T21, a first level signal is provided to the first scanning signal terminal Scan1, the second scanning signal terminal Scan2 and the second light emitting signal terminal Emit2. A second level signal is provided to the first light emitting signal terminal Emit1. A first data signal Vdata1 is provided to the data signal terminal. A first initialization signal VRef1 is provided to the first initialization signal terminal VREF. The data writing module 33 in the pixel driving circuit 300 transmits the first data signal Vdata1 to the second electrode plate 102 (N3 node) of the first capacitor C1. The initialization module 32 transmits the first initialization signal VRef1 to the first electrode (N2 node) of the driving transistor. The light emitting control module 24 and the initialization module 32 transmit the signal $V_{PVDD}$ of the first voltage terminal PVDD to the gate (N1 node) of the driving transistor DT. Specifically, the fourth transistor is turned on, and the first initialization signal VRef1 is transmitted to the first electrode (N2 node) of the driving transistor DT. The second transistor M2 and the third transistor M3 are turned on, and the signal $V_{PVDD}$ of the first voltage terminal PVDD is transmitted to the second electrode (N2 node) and gate (N1 node) of the driving transistor DT. The fifth transistor M5 is turned on, and the first data signal Vdata1 is transmitted to the second electrode plate 102 (N3 node) of the first capacitor. At this time, the potential at the N1 node VN1=$V_{PVDD}$, the potential at the N2 node VN2=VRef1, the potential at the N3 node VN3=Vdata1, the potential at the N4 node VN4=$V_{PVDD}$. Here, the difference between the signal VPVD of the first voltage terminal PVDD and the voltage value of the first initialization signal VRef1 is greater than the threshold voltage Vth of the driving transistor DT, i.e., $V_{PVDD}$−VRef1>Vth.

In the second phase T22, the second level signal is provided to the first light emitting signal terminal Emit1 and the second light emitting signal terminal Emit2. The first level signal is provided to the first scanning signal terminal Scan1 and the second scanning signal terminal Scan2. The first initialization signal VRef1 is provided to the first initialization signal terminal VREF. The third transistor M3, the fourth transistor M4 and the fifth transistor M5 are turned on. The first initialization signal VRef1 and the first data signal Vdata1 are respectively transmitted to the N2 node and the N3 node. At this time, the N1 node is in a vacated state, and since the voltage difference between the gate and the first electrode of the driving transistor DT in the first phase T21 is greater than its threshold voltage Vth, the driving transistor DT is turned on and the potential at the N1 node gradually decreases. When the potential at the N1 node drops to VRef1+Vth, the driving transistor DT is turned off, the potential at the N1 node VN1=VRef1+Vth, the potential at the N2 node VN2=VRef1, and the potential at the N3 node VN3=Vdata1.

In the third phase T23, the first level signal is provided to the first light emitting signal terminal Emit1 and the second scanning signal terminal Scan2. The second level signal is provided to the second light emitting signal terminal Emit2 and the first scanning signal terminal Scan1. A second data signal Vdata2 is provided to the data signal terminal. The voltage values of the first data signal Vdata1 and the second data signal Vdata2 may not be equal. The data writing module 33 (i.e., the fifth transistor M5) writes the second data signal Vdata2 to the second electrode plate 102 (N3 node) of the first capacitor C1. The potential VN3 of the N3 node is changed from Vdata1 to Vdata2. The potential at the gate (N1 node) of the driving transistor DT changes under the coupling of the first capacitor C1 and the change is identical to the potential change of the N3 node, then at this time the potential at the N1 node is VN1=VRef1+Vth+Vdata2−Vdata1. At the present phase, the first transistor M1 is turned on, the potential at the N2 node is equal to the potential at the N3 node, VN2=VN3=Vdata2.

In the fourth phase T24, the first level signal is provided to the first light emitting signal terminal Emit1 and the second light emitting signal terminal Emit2. The second level signal is provided to the first scanning signal terminal Scan1 and the second scanning signal terminal Scan2. The driving transistor DT is turned on. The organic light emitting diode D1 emits light based on the potential difference Vgs between the gate and the first electrode of the driving transistor DT. At this time, the source of the driving transistor DT is the N2 node, and the gate source voltage difference of the driving transistor is Vgs=$V_{N1}$−$V_{N2}$=VRef1+Vth+Vdata2−Vdata1−Vdata2=VRef1+Vth−Vdata1. The light emitting current Ids of the organic light emitting diode D1 can be calculated using the following equation (2):

$$\begin{aligned} i)\quad Ids &= K\square(Vgs-|Vth|)^2 \\ &= K\square(VRef1+Vth-Vdata1-Vth)^2 \\ &= K\square(VRef1-Vdata1)^2 \end{aligned} \tag{2}$$

Here, K is the ratio of the width and the length of the channel of the driving transistor DT, the related coefficient of capacitance per unit area of the driving transistor DT. As can be observed from the equation (2), the light emitting current Ids of the organic light emitting diode D1 is independent of the threshold voltage Vth of the driving transistor DT, thereby the pixel driving circuit 300 shown in FIG. 3 may also realize the compensation to the threshold voltage of the driving transistor, and eliminate the impact of the capacitance value of the organic light emitting diode D1 on the display luminance, improving the display effect.

Alternatively, similarly to the embodiment shown in FIG. 9, before the first phase T21, the fifth phase T25 may be included. In the fifth phase T25, the first level signal may be provided to the second light emitting signal terminal Emit2, and the second level signal may be provided to the first light emitting signal terminal Emit1, the first scanning signal terminal Scan1 and the second scanning signal terminal Scan2 to turn on the second transistor M2 to initialize the potential at the second electrode (N4 node) of the driving transistor DT to $V_{PVDD}$. Thus, the potential at the N1 node may rapidly rise to $V_{PVDD}$ after the first level signal is provided to the first scanning signal terminal Scan1 in the above first phase.

With further reference to FIG. 10, a schematic diagram of the operation timing sequence of the pixel driving circuit as shown in FIG. 4 is illustrated.

For the pixel driving circuit 400 shown in FIG. 4, in the first phase T31, a first level signal is provided to the first scanning signal terminal Scan1 and the second light emitting signal terminal Emit2. A second level signal is provided to the first light emitting signal terminal Emit1, the second scanning signal terminal Scan2 and the third scanning signal terminal Scan3. The first data signal Vdata is provided to the data signal terminal. A second initialization signal Vini is provided to the second initialization signal terminal VIN. The initialization module 42 transmits the second initialization signal Vini to the gate (N1 node) of the driving transistor ft. At this time, the potential at the N1 node is VN1=Vini. The voltage value of the second initialization signal Vini is high, so that the driving transistor DT is turned on.

In the second phase T32, the second level signal is provided to the first scanning signal terminal Scan1, the first light emitting signal terminal Emit1 and the second light emitting signal terminal Emit2. The first level signal is provided to the second scanning signal terminal Scan2 and the third scanning signal terminal Scan3. The first initialization signal VRef1 is provided to the first initialization signal terminal VREF. The first data signal Vdata is provided to the data signal terminal. The initialization module 42 transmits the first initialization signal VRef1 to the first electrode (N2 node) of the driving transistor DT. The data writing module 33 transmits the first data signal Vdata to the second electrode plate 102 (N3 node) of the first capacitor C1. At this time, the fourth transistor M4 is turned on, the potential at the N2 node is VN2=VRef1, and the potential at the N3 node is VN3=Vdata. The voltage value of the second initialization signal Vini is greater than the sum of the threshold voltage Vth of the driving transistor DT and the voltage value of the first initialization signal VRef1, i.e., Vini>VRef1+Vth. When the N1 node is in a vacated state, the driving transistor DT is turned on and the potential at the N1 node decreases. Until the potential at the N1 node decreases to VRef1+Vth, the driving transistor DT is turned off, and the potential at the N1 node no longer changes, the potential at the N1 node VN1=VRef1+Vth.

In the third phase T33, the first level signal is provided to the first light emitting signal terminal Emit1 and the third scanning signal terminal Scan3. The second level signal is provided to the first scanning signal terminal Scan1, the second scanning signal terminal Scan2 and the second light emitting signal terminal Emit2. The first initialization signal VRef1 is provided to the first initialization signal terminal VREF. The first transistor M1 and the fourth transistor M4 are turned on. The potential at the N2 node is maintained at VN2=VRef1. The potential at the N3 node changes to the first initialization signal VRef1, i.e., VN3=VRef1. Thus, the potential at the N1 node is changed under the coupling of the first capacitor C1 and the change is identical to that of the N3 node, both of which are VRef1− Vdata, and the potential at the N1 node is VN1=VRef1+Vth+VRef1−Vdata.

In the fourth phase T34, the first level signal is provided to the first light emitting signal terminal Emit1 and the second light emitting signal terminal Emit2. The second level signal is provided to the first scanning signal terminal Scan1, the second scanning signal terminal Scan2 and the third scanning signal terminal Scan3. The organic light emitting diode D1 emits light based on the potential difference between the gate and the first electrode of the driving transistor DT. At this time, the source of the driving transistor DT is the N2 node, and the gate source voltage difference of the driving transistor is Vgs=$V_{N1}$−$V_{N2}$=2∇VRef1+Vth−Vdata−VRef1=VRef1+Vth−Vdata. The light emitting current Ids of the organic light emitting diode D1 can be calculated using the following equation (3):

$$i)\quad Ids = K\square(Vgs - |Vth|)^2 \qquad (3)$$
$$= K\square(VRef1 + Vth - Vdata - Vth)^2$$
$$= K\square(VRef1 - Vdata)^2$$

Here, K is the ratio of the width and the length of the channel of the driving transistor DT, the related coefficient of capacitance per unit area of the driving transistor DT. As can be observed, the equation (1) and the equation (3) are the same. The light emitting current Ids of the organic light emitting diode D1 is independent of the threshold voltage Vth of the driving transistor DT, thereby the pixel driving circuit 400 shown in FIG. 4 may also realize the compensation to the threshold voltage of the driving transistor. In addition, the light emitting current of the organic light emitting diode D1 is also independent of the capacitance values of the first capacitor C1 and the organic light emitting diode D1, which eliminates the impact of the capacitance value of the organic light emitting diode D1 on the display luminance, thereby avoiding the impact of the organic light emitting diode D1 on the display luminance uniformity and improving the display effect.

In addition, as can be observed from FIG. 10, the signal SC2 of the second scanning signal terminal Scan2 and the signal SC1 of the first scanning signal terminal Scan1 are both single pulse signals, and the pulse widths of the signals are equal to each other. The signal of the second scanning signal terminal Scan2 and the signal of the first scanning signal terminal Scan1 have a pulse width shifting, when the organic light emitting display panel 700 including the pixel driving circuit 400 is designed, in the adjacent two rows of pixel driving circuits 71, the second scanning signal terminal Scan2 of the first row of pixel driving circuits 71 may be connected to a common first scanning signal line or a common second scanning signal line with the first scanning signal terminal Scan1 of the second row of pixel driving circuits 71, thereby reducing the number of signal lines in the organic light emitting display panel and improving the aperture ratio and the resolution of the organic light emitting display panel.

The present disclosure also provides an organic light emitting display apparatus, as shown in FIG. 10, the organic light emitting display apparatus 1000 includes the organic light emitting display panel of each of the embodiments described above, and may be a mobile phone, a tablet computer, a wearable device, or the like. It is understandable that the organic light emitting display apparatus 1000 may include a known structure such as a package film and a protective glass, therefore detailed description will be omitted.

The foregoing is only a description of the preferred embodiments of the present disclosure and the applied technical principles. It should be appreciated by those skilled in the art that the inventive scope of the present disclosure is not limited to the technical solutions formed by the particular combinations of the above technical features. The inventive scope should also cover other technical solutions formed by any combinations of the above technical features or equivalent features thereof without departing from the concept of the invention, such as, technical solutions formed by replacing the features as disclosed in the present disclosure with (but not limited to), technical features with similar functions.

What is claimed is:

1. An organic light emitting display panel, comprising:

a plurality of pixel driving circuits arranged in a matrix of rows and columns, the plurality of pixel driving circuits comprising a first scanning signal terminal, a second scanning signal terminal, a first light emitting signal terminal, a second light emitting signal terminal, a data signal terminal, a first initialization signal terminal, a first voltage terminal, a second voltage terminal, a driving module, an initialization module, a data writing module, a light emitting control module and an organic light emitting diode;

wherein the driving module comprises a driving transistor and a first capacitor, wherein the first capacitor includes a first electrode plate and a second electrode plate, wherein a gate of the driving transistor is electrically connected to the first electrode plate of the first capacitor, wherein a first electrode of the driving transistor is electrically connected to an anode of the organic light emitting diode;

wherein the initialization module is electrically connected to the first scanning signal terminal and the first initialization signal terminal, for initializing potentials of the gate and the first electrode of the driving transistor at least under the control of the first scanning signal terminal;

wherein the data writing module being electrically connected to the first scanning signal terminal or the second scanning signal terminal and the data signal terminal, for transmitting a signal of the data signal terminal to the second electrode plate of the first capacitor under the control of the first scanning signal terminal or the second scanning signal terminal;

wherein the light emitting control module is electrically connected to the first light emitting signal terminal, the second light emitting signal terminal, the first voltage terminal and the first electrode and a second electrode of the driving transistor, for transmitting the potential signal of the first electrode of the driving transistor to the second electrode plate of the first capacitor under the control of the first light emitting signal terminal, and driving the organic light emitting diode to emit light based on a signal of the first voltage terminal under the control of the second light emitting signal terminal; and wherein a cathode of the organic light emitting diode is electrically connected to the second voltage terminal.

2. The organic light emitting display panel according to claim 1, wherein the light emitting control module comprises a first transistor and a second transistor;

wherein a gate of the first transistor is electrically connected to the first light emitting signal terminal, wherein a first electrode of the first transistor is electrically connected to the first electrode of the driving transistor, wherein a second electrode of the first transistor is electrically connected to the second electrode plate of the first capacitor; and wherein a gate of the second transistor is electrically connected to the second light emitting signal terminal, wherein a first electrode of the second transistor is electrically connected to the first voltage terminal, wherein a second electrode of the second transistor is electrically connected to the second electrode of the driving transistor.

3. The organic light emitting display panel according to claim 2, wherein the initialization module further comprises a third transistor and a fourth transistor, and the data writing module comprises a fifth transistor;

wherein a first electrode of the third transistor is electrically connected to the second electrode of the driving transistor, and a second electrode of the third transistor is electrically connected to the gate of the driving transistor;

wherein a first electrode of the fourth transistor is electrically connected to the first initialization signal terminal, and a second electrode of the fourth transistor is electrically connected to the first electrode of the driving transistor; and wherein a first electrode of the fifth transistor is electrically connected to the data signal terminal, and a second electrode of the fifth transistor is electrically connected to the second electrode plate of the first capacitor.

4. The organic light emitting display panel according to claim 3, wherein a gate of the third transistor is electrically connected to the first scanning signal terminal, wherein-a gate of the fourth transistor is electrically connected to the second scanning signal terminal, and wherein—a gate of the fifth transistor is electrically connected to the first scanning signal terminal.

5. The organic light emitting display panel according to claim 3, wherein a gate of the third transistor is electrically connected to the first scanning signal terminal, wherein—a gate of the fourth transistor is electrically connected to the first scanning signal terminal, and wherein—a gate of the fifth transistor is electrically connected to the second scanning signal terminal.

6. The organic light emitting display panel according to claim 3, further comprising a plurality of first scanning signal lines, a plurality of second scanning signal lines, a plurality of first light emitting signal lines, a plurality of second light emitting signal lines, a plurality of data signal lines, at least one first initialization signal line, a first voltage signal line and a second voltage signal line;

wherein the first scanning signal terminal of each of the plurality of pixel driving circuits is electrically connected to one of the first scanning signal lines, the second scanning signal terminal of each of the pixel driving circuits is electrically connected to one of the second scanning signal lines, the first light emitting signal terminal of each of the pixel driving circuits is electrically connected to one of the first light emitting signal lines, the second light emitting signal terminal of each of the plurality of pixel driving circuits is electrically connected to one of the second light emitting signal lines, the data signal terminal of each of the pixel driving circuits is electrically connected to one of the data signal lines, the first initialization signal terminal of each of the pixel driving circuits is electrically connected to one of the first initialization signal lines, the first voltage terminal of each of the pixel driving circuits is electrically connected to the first voltage signal line, and the second voltage terminal of each of the plurality of pixel driving circuits is electrically connected to the second voltage signal line.

7. The organic light emitting display panel according to claim 6, wherein the organic light emitting display panel further comprises a third scanning signal terminal, a gate of the third transistor is electrically connected to the second scanning signal terminal, agate of the fourth transistor is electrically connected to the third scanning signal terminal, and a gate of the fifth transistor is electrically connected to the second scanning signal terminal.

8. The organic light emitting display panel according to claim 7, wherein the plurality of pixel driving circuits each further comprises a second initialization signal terminal, wherein the initialization module further comprises a sixth transistor, wherein a gate of the sixth transistor is electrically connected to the first scanning signal terminal, a first electrode of the sixth transistor is electrically connected to the second initialization signal terminal, a second electrode of the sixth transistor is electrically connected to the gate of the driving transistor.

9. The organic light emitting display panel according to claim 8, further comprises a plurality of third scanning signal lines and a plurality of second initialization signal lines, wherein the third scanning signal terminal of each of the plurality of pixel driving circuits is electrically connected to one of the third scanning signal lines, wherein the second initialization signal terminal of each of the pixel driving circuits is electrically connected to one of the second initialization signal lines.

10. The organic light emitting display panel according to claim 6, wherein the organic light emitting display panel further comprises a plurality of third scanning signal lines and a plurality of second initialization signal lines, wherein each of the first scanning signal lines is electrically connected to the first scanning signal terminals of a row of the plurality of pixel driving circuits respectively, each of the second scanning signal lines is respectively electrically connected to the second scanning signal terminals of a row of the plurality of pixel driving circuits;

wherein each of the first light emitting signal lines is respectively electrically connected to the first light emitting signal terminals of a row of the pixel driving circuits, wherein each of the second light emitting signal lines is electrically connected to the second light emitting signal terminals of a row of the pixel driving circuits respectively;

wherein each of the data signal lines is electrically connected to the data signal terminals of a column of the pixel driving circuits respectively, wherein each of the first initialization signal lines is electrically connected to the first initialization signal terminals of a column of the pixel driving circuits respectively; and wherein the first voltage terminal of each of the plurality pixel driving circuits is electrically connected to the first voltage signal line, and wherein the second voltage terminal of each of the plurality of pixel driving circuits is electrically connected to the second voltage signal line.

11. The organic light emitting display panel according to claim 10, wherein the first initialization signal terminal of each of the plurality of pixel driving circuits is electrically connected to a common first initialization signal line.

12. A driving method for the organic light emitting display panel according to claim 1, the driving method comprising:

in a first phase, providing a first level signal to the first scanning signal terminal and the second light emitting signal terminal, providing a second level signal to the first light emitting signal terminal, providing a first data signal to the data signal terminal, initializing the potentials of the gate of the driving transistor and the second electrode of the driving transistor with the initialization module;

in a second phase, providing the second level signal to the first light emitting signal terminal and the second light emitting signal terminal, providing the first level signal to the second scanning signal terminal, providing a first initialization signal to the first initialization signal terminal, transmitting the first initialization signal from the initialization module to the first electrode of the driving transistor;

in a third phase, providing the first level signal to the first light emitting signal terminal, changing the potential at the gate of the driving transistor under a coupling effect of the first capacitor; and in a fourth phase, providing the first level signal to the first light emitting signal terminal and the second light emitting signal terminal, providing the second level signal to the first scanning signal terminal and the second scanning signal terminal, emitting light from the organic light emitting diode based on a potential difference between the gate and the first electrode of the driving transistor.

13. The driving method according to claim 12, wherein the initialization module comprises a third transistor and a fourth transistor, the data writing module comprises a fifth transistor, a first electrode of the third transistor is electrically connected to the second electrode of the driving transistor, a second electrode of the third transistor is electrically connected to the gate of the driving transistor, a gate of the third transistor is electrically connected to the first scanning signal terminal, a first electrode of the fourth transistor is electrically connected to the first initialization signal terminal, a second electrode of the fourth transistor is electrically connected to the first electrode of the driving transistor, a gate of the fourth transistor is electrically connected to the second scanning signal terminal, a first electrode of the fifth transistor is electrically connected to the data signal terminal, a second electrode of the fifth transistor is electrically connected to the second electrode plate of the first capacitor, a gate of the fifth transistor is electrically connected to the first scanning signal terminal, the driving method further comprising:

in the first phase, providing the second level signal to the second scanning signal terminal, writing the first data signal to the second electrode plate of the first capacitor by the data writing module;

in the second phase, providing the first level signal to the first scanning signal terminal;

in the third phase, providing the second level signal to the first scanning signal terminal, providing the first level signal to the second scanning signal terminal, providing the first initialization signal to the first initialization signal terminal, transmitting the first initialization signal to the first electrode of the driving transistor by the initialization module.

14. The driving method according to claim 13, wherein the light emitting control module comprises a first transistor and a second transistor, a gate of the first transistor is electrically connected to the first light emitting signal terminal, a first electrode of the first transistor is electrically connected to the first electrode of the driving transistor, a second electrode of the first transistor is electrically connected to the second electrode plate of the first capacitor; agate of the second transistor is electrically connected to the second light emitting signal terminal, a first electrode of the second transistor is electrically connected to the first voltage terminal, a second electrode of the second transistor is electrically connected to the second electrode of the driving transistor;

the driving method further comprises:

in the first phase, transmitting a signal of the first voltage terminal to the gate of the driving transistor at the light emitting control module and the initialization module.

15. The driving method according to claim 12, wherein the initialization module comprises a third transistor and a fourth transistor, the data writing module comprises a fifth transistor, a first electrode of the third transistor is electrically connected to the second electrode of the driving transistor, a second electrode of the third transistor is electrically connected to the gate of the driving transistor, a gate of the third transistor is electrically connected to the first scanning signal terminal, a first electrode of the fourth transistor is electrically connected to the first initialization signal terminal, a second electrode of the fourth transistor is electrically connected to the first electrode of the driving transistor, a gate of the fourth transistor is electrically connected to the first scanning signal terminal, a first electrode of the fifth transistor is electrically connected to the data signal terminal, a second electrode of the fifth transistor is electrically connected to the second electrode plate of the first capacitor, a gate of the fifth transistor is electrically connected to the second scanning signal terminal, the driving method further comprising:

in the first phase, providing the first level signal to the second scanning signal terminal, providing the first initialization signal to the first initialization signal terminal, transmitting the first data signal to the second electrode plate of the first capacitor by the data writing module, transmitting the first initialization signal from the initialization module to the first electrode of the driving transistor;

in the second phase, providing the first level signal to the first scanning signal terminal;

in the third phase, providing the second level signal to the first scanning signal terminal, providing the first level signal to the second scanning signal terminal, providing a second data signal to the data signal terminal, transmitting the second data signal to the second electrode plate of the first capacitor by the data writing module.

16. The driving method according to claim 15, wherein the light emitting control module comprises a first transistor and a second transistor, a gate of the first transistor is electrically connected to the first light emitting signal terminal, a first electrode of the first transistor is electrically connected to the first electrode of the driving transistor, a second electrode of the first transistor is electrically connected to the second electrode plate of the first capacitor; agate of the second transistor is electrically connected to the second light emitting signal terminal, a first electrode of the second transistor is electrically connected to the first voltage terminal, a second electrode of the second transistor is electrically connected to the second electrode of the driving transistor;

the driving method further comprises:

in the first phase, transmitting a signal of the first voltage terminal to the gate of the driving transistor at the light emitting control module and the initialization module.

17. The driving method according to claim 12, wherein the pixel driving circuit further comprises a second initialization signal terminal, the initialization module further comprises a sixth transistor, a gate of the sixth transistor is electrically connected to the first scanning signal terminal, a first electrode of the sixth transistor is electrically connected to the second initialization signal terminal, a second electrode of the sixth transistor is electrically connected to the gate of the driving transistor;

wherein the organic light emitting display panel further includes a third scanning signal terminal, the initialization module includes a third transistor and a fourth transistor, the data writing module includes a fifth transistor, a first electrode of the third transistor is electrically connected to the second electrode of the driving transistor, a second electrode of the third transistor is electrically connected to the gate of the driving transistor, a gate of the third transistor is electrically connected to the second scanning signal terminal, a first electrode of the fourth transistor is electrically connected to the first initialization signal terminal, a second electrode of the fourth transistor is electrically connected to the first electrode of the driving transistor, a gate of the fourth transistor is electrically connected to the third scanning signal terminal, a first electrode of the fifth transistor is electrically connected to the data signal terminal, a second electrode of the fifth transistor is electrically connected to the second electrode plate of the first capacitor, a gate of the fifth transistor is electrically connected to the second scanning signal terminal;

the driving method further comprises:

in the first phase, providing a second level signal to the second scanning signal terminal and the third scanning signal terminal, providing the second initialization signal to the second initialization signal terminal, transmitting the second initialization signal from the initialization module to the gate of the driving transistor;

in the second phase, providing the second level signal to the first scanning signal terminal, providing the first level signal to the third scanning signal terminal, providing the first data signal to the data signal terminal, providing the first data signal to the second electrode plate of the first capacitor by the data writing module;

in the third phase, providing the second level signal to the first scanning signal terminal and the second scanning signal terminal, providing the first level signal to the third scanning signal terminal, providing the first initialization signal to the first initialization signal terminal;

in the fourth phase, providing the second level signal to the second scanning signal terminal;

wherein the voltage value of the second initialization signal is greater than the sum of the threshold voltage of the driving transistor and the voltage value of the first initialization signal.

18. An organic light emitting display apparatus comprising the organic light emitting display panel according to claim 1.

* * * * *